United States Patent [19]

Sexton

[11] Patent Number: 4,955,480

[45] Date of Patent: Sep. 11, 1990

[54] PORTABLE INSULATED CARRIER

[76] Inventor: Wilson C. Sexton, 18621 State Rte. 31, North Fort Myers, Fla. 33917

[21] Appl. No.: 383,933

[22] Filed: Jul. 21, 1989

[51] Int. Cl.[5] ..... B65D 81/18

[52] U.S. Cl. ..... 206/528; 62/372; 62/457.9; 206/438; 206/446; 206/523; 220/339; 220/359

[58] Field of Search ..... 62/371, 372, 457.9; 206/438, 446, 523, 570, 803, 528; 215/13.1; 220/3.1, 339, 359

[56] References Cited

U.S. PATENT DOCUMENTS

| | | | |
|---|---|---|---|
| 1,963,743 | 6/1934 | Hoodless . | |
| 3,027,286 | 3/1962 | Kurhan | 206/523 |
| 3,103,278 | 9/1963 | Kuzma et al. | 206/523 |
| 3,148,515 | 9/1964 | Jentis et al. . | |
| 3,241,661 | 3/1966 | Zamzow et al. | 206/523 |
| 3,263,806 | 8/1966 | Ring | 206/523 |
| 3,273,354 | 9/1966 | Gibson . | |
| 3,309,893 | 3/1967 | Heffler et al. . | |
| 3,738,480 | 6/1973 | Chelsey | 206/359 |
| 3,810,367 | 5/1974 | Peterson . | |
| 4,240,271 | 12/1980 | Brownlow . | |
| 4,250,998 | 2/1981 | Taylor . | |
| 4,322,954 | 4/1982 | Sheehan et al. . | |
| 4,429,793 | 2/1984 | Ehmann . | |
| 4,530,816 | 7/1985 | Douglas-Hamilton . | |
| 4,560,069 | 12/1985 | Simon | 206/523 |
| 4,573,581 | 3/1986 | Galloway et al. . | |
| 4,745,776 | 5/1988 | Clark . | |
| 4,746,017 | 5/1988 | Howard et al. | 206/438 |

FOREIGN PATENT DOCUMENTS

| | | | |
|---|---|---|---|
| 0990011 | 4/1965 | United Kingdom | 215/13.1 |

*Primary Examiner*—Jimmy G. Foster

*Attorney, Agent, or Firm*—Wood, Herron & Evans

[57] ABSTRACT

A portable carrier for transporting pharmaceutical preparations while protecting those preparations against degradation by ambient temperature conditions, which carrier comprises three blocks of expanded polystyrene foam. One of these three blocks is a central body block having a bore extending vertically therethrough; the second is a base block; and the third is a lid block hingedly connected to the central body block. The lid and top of the body block have contact cement applied thereto such that the lid is repeatedly operable and sealingly reclosable. A sealed, hollow, plastic ball containing refreezable liquid is locatable within the bore of the body block along with a vial of medication so as to maintain that medication at a refrigerated temperature.

3 Claims, 1 Drawing Sheet

PORTABLE INSULATED CARRIER

FIELD OF INVENTION

This invention relates to insulated carriers and, more particularly, to portable insulated carriers for transporting pharmaceutical preparations, such as insulin, while protecting those pharmaceutical preparations from degradation by ambient temperature conditions.

BACKGROUND OF THE INVENTION

Many pharmaceutical materials, such as, for example, insulin, are subject to rapid deterioration or degradation when exposed to ambient temperature conditions. This characteristic of the pharmaceutical materials makes it very difficult for persons required to regularly use such preparations to carry them on their person while maintaining them at a temperature sufficiently cool as to prevent degradation of the material. As an example, insulin is required to be maintained at a temperature of substantially below ambient temperature in order to avoid deterioration and degradation. Many persons who regularly use insulin require dosages two or three times a day. Those persons are required to transport this insulin supply with them whenever they are away from their refrigerated insulin supply for a period longer than three or four hours. Generally, such persons simply utilize a small cooler filled with ice to transport their insulin supply, but this is extremely difficult in many situations, as for example, when moving about on an all-day shopping trip or when on an all-day hike, etc.

In order to enable persons who regularly need cooled medication to transport a limited supply of that medication, it has been proposed to utilize small, portable carriers for transporting a limited supply of such medication. One such carrier is disclosed in Galloway, et al. U.S. Pat. No. 4,573,481. The carrier disclosed in this patent, though, while relatively small and portable, is one which is relatively expensive to manufacture and/or for a user to purchase because of its numerous plies of insulating material, heat sink material and heat reflective material.

A less expensive insulated container for transporting heat sensitive materials is disclosed in Heffler, et al. U.S. Pat. No. 3,309,893. This patent discloses an insulative container made from rigid polyurethane foam within which there is a central cavity. This cavity is closed by a lid of flexible polyurethane foam which fits tightly within and seals the cavity after placement of the heat-sensitive material within the cavity of the container. This container, though, is also excessively expensive for many applications.

SUMMARY OF THE INVENTION

It has therefore been an objective of this invention to provide an inexpensive, but effective, portable carrier for pharmaceutical preparations which is sufficiently insulative so as to enable pharmaceutical preparations to be transported for a period of up to 12 hours, depending upon ambient temperature conditions, without a significant increase in temperature.

More specifically, it has been an objective of this invention to provide a portable insulated carrier for a one-day supply of insulin which will enable that insulin supply to be transported for up to 12 hours without a significant increase in temperature. The portable insulated carrier of this invention comprises a first or central block of expanded polystyrene foam shaped as a rectangular parallelepiped, which central block has a cylindrical bore extending vertically therethrough. A base block of expanded polystyrene foam is fixedly secured to the bottom of the first or central block, and a closure lid of expanded polystyrene foam is hingedly secured to the top of the first or central block. Contact adhesive applied to the top surface of the central block and the bottom surface of the lid releasably and sealingly secures the lid in a closed position relative to the central block. Contained within the carrier is an opaque or light resistant plastic vial, which vial is adapted to receive a container of temperature-sensitive pharmaceutical preparation. Also contained within the carrier is a closed and sealed container of refreezable liquid, which liquid may be water or a collagen matrix containing thermal and chemical stabilizers.

In the use of this portable carrier, a vial of insulin or other pharmaceutical preparation is placed within the plastic vial, and the cap of that vial is closed. The container of refreezable liquid, which may be in the form of a plastic ball, is then removed from a freezer and inserted into the bore of the carrier, along with the medication-containing vial. The lid of the carrier is then closed. The contact adhesive on the bottom of the lid and the contact adhesive on the top surface of the central block of the carrier, when contacting each other, effectively seal and maintain the lid of the carrier closed until such time as the user desires to open the carrier in order to access the vial of pharmaceutical preparation. One contact cement which has been found to be particularly suitable for this application is a contact cement identified as "Elmer Saf-T" contact cement manufactured by Borden, Inc. When applied to expanded polystyrene foam, as on the lid and body of the carrier, this cement has been found to enable the lid of the carrier to releasably adhere to the body through several hundred opening and closing cycles of the lid without any appreciable loss of adhesive properties of the material and without any appreciable loss in sealing qualities of the lid relative to the body of the carrier.

The primary advantage of this invention is that it provides a very inexpensive, but effective, portable insulated carrier for pharmaceutical preparations. In fact, the carrier may be manufactured and sold so inexpensively that in some instances, it may be given away to users of the pharmaceutical preparation by pharmacies in order to facilitate use of the medication by the user of that pharmaceutical preparation.

These and other objects and advantages of this invention will be more readily apparent from the following description of the drawings in which.

Figure 1:
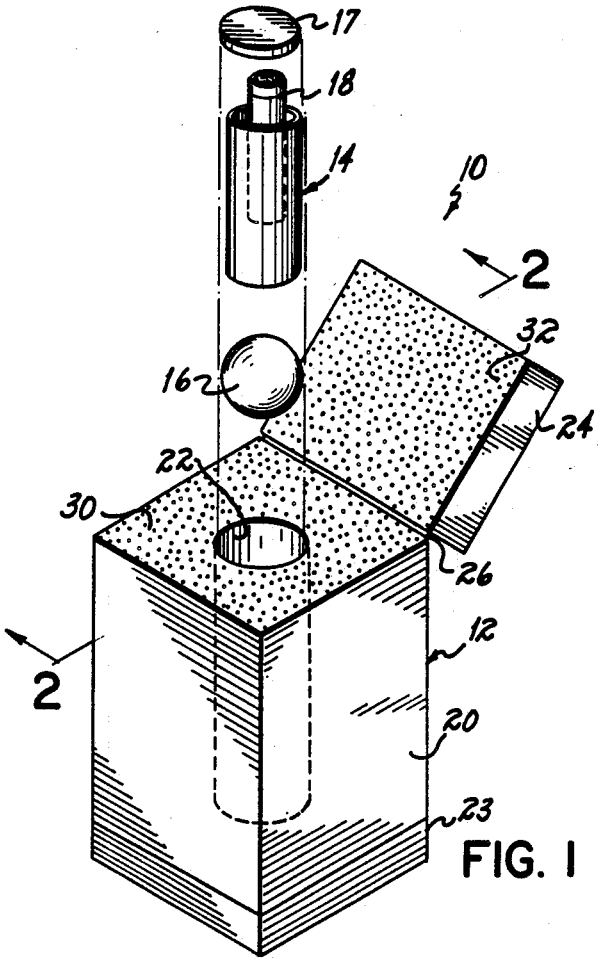
FIG. 1 is a perspective view of the carrier of this invention.

With reference to the drawings, it will be seen that the carrier 10 comprises an insulated container 12 for housing a plastic vial 14 and a hollow, plastic ball or container 16. The vial 14 is a conventional medication-containing vial of the type which includes a removable lid 17. Located within the vial 14 is a vial of medical preparation 18. One use of this invention is to transport a vial of insulin, which vial generally contains at least a one-day supply of insulin for a user of that medical preparation. The ball 16 is hollow and spherical in shape and contains a refreezable liquid 19, such as water, or a degraded collagen matrix containing thermal and chemical stabilizers.

The insulated container 12 is made from three blocks of expanded polystyrene foam. Each of these blocks is shaped as a rectangular parallelepiped. The central block or body 20 of expanded polystyrene foam is substantially larger than the other two blocks. It has a cylindrical vertical bore 22 extending therethrough. The bottom block 23 or base of expanded polystyrene foam is fixedly secured to the bottom surface of the central block or body 20 and is operative to close the bottom end of the bore 22.

Figure 2:
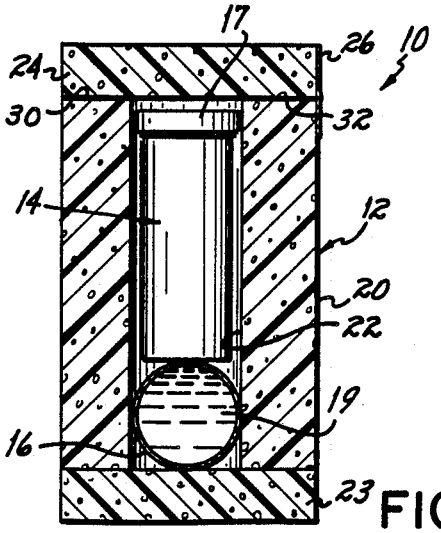
FIG. 2 is a cross-sectional view taken on line 2—2 of FIG. 1.

The third block 24 of insulated polystyrene foam is hingedly secured to the top of the central block or body 20 by a strip of flexible tape 26 such that the third block or lid 24 is movable between an open position (illustrated in FIG. 1) and a closed position (illustrated in FIG. 2).

In the preferred practice of this invention, these three blocks of expanded polystyrene foam are all cut by a hot wire from a larger block of one-pound density expanded polystyrene foam. Conventionally, such a hot wire cutter is computer controlled so as to repeatedly and inexpensively generate appropriate sized blocks of foam for use in the practice of this invention.

In the preferred practice of this invention, the central block or body 20 of expanded polystyrene foam is square when viewed in top plan with sides approximately two inches in length. In this preferred embodiment, this block 20 is approximately 3½ inches in height. The vertical bore is 1¼ inches in diameter. The base block 24 and the lid block 26 are of the same size and, in fact, are interchangeable. In the preferred practice of this invention, these two blocks are each square when viewed in top plan with sides approximately two inches in length. Each block 24, 26 is approximately ½ inch in height.

The lid 24 of the insulated container 12 is releasably and sealingly secured to the top surface 30 of the central block 20 by a contact adhesive applied to the top surface 30 of the central block and to the inside or bottom surface 32 of the lid 24. In a preferred embodiment, this contact cement is identified as "Elmer Saf-T" contact cement manufactured by Borden, Inc. It has been found that this particular adhesive when applied to an expanded polystyrene foam block may be utilized through several hundred opening and closing cycles of the lid to releasably, but sealingly, secure the lid to the central block of the container 20.

In the use of the carrier 10 of this invention, the ball 16 of refreezable liquid or of collagen matrix is placed into a freezer and left there for a sufficiently long period of time as to freeze the liquid 19 contained within the ball 16. The ball is then inserted into the cylindrical bore 22 of the container 12, followed by the vial 14, which vial contains another smaller vial of medicinal or pharmaceutical preparation 18. The vial 14 is generally opaque or light resistant and has a lid 17 applied thereto and closed after insertion of the vial of medication 18. With the vial of medication 18 contained within the plastic vial 14, and both the vial 14 and ball of frozen liquid 16 contained within the cylindrical bore 22 of the carrier 20, the lid 24 is closed and sealingly secured in that position by the adhesive on the bottom or inside surface 32 of the lid and the top surface 30 of the central block or body 20. The carrier 10 may then be transported by the user of that medical preparation, and periodically, the insulated container 12 may be opened by lifting of the lid 24 about the hinge provided by the tape 26. The vial 14 may then be removed and the vial of medication 18 removed from the plastic vial 14 and used by the person requiring the medication. Thereafter, the medication and the vial 14 may be returned to the insulated container 12 and the lid closed preparatory to further transportion and reuse of the medication.

In practice, it has been found that a vial of medication, such as insulin, may be utilized with this carrier and may be easily transported throughout one day without the medication reaching a temperature detrimental to the maintenance of that medical preparation.

While I have described only a single preferred embodiment of my invention, persons skilled in this art will appreciate changes and modifications which may be made without departing from the spirit of my invention. Therefore, I do not intend to be limited except by the following claims.

I claim:

1. A portable carrier for transporting pharmaceutical preparations while protecting those preparations from degradation by ambient temperature conditions, which carrier comprises a first block of expanded polystyrene foam shaped as a rectangular parallelepiped, which block has a cylindrical bore extending vertically through the first block, a base block of expanded polystyrene foam fixedly secured to the bottom of said first block, said base block being operative to permanently close a bottom end of said cylindrical bore, a closure lid of expanded polystyrene foam located on the top of said first block, said closure lid being hingedly connected along one side to one side of said first block so as, when closed, to cover a top end of said cylindrical bore, contact adhesive applied to a top surface of said first block and a bottom surface of said lip for releasably sealing said lid in a closed position relative to said first block, and a closed and sealed hollow plastic ball containing a refreezable liquid, said ball being located within said cylindrical bore, said ball being slightly smaller in diameter than the diameter of said cylindrical bore.

2. A portable carrier for transporting pharmaceutical preparations while protecting those preparations from degradation by ambient temperature conditions, which carrier comprises a first block of expanded polystyrene foam, which block has a bore extending vertically through the first block, a base block of expanded polystyrene foam fixedly secured to the bottom of said first block, said base block being operative to permanently close a bottom end of said cylindrical bore, a closure lid of expanded polystyrene foam located on the top of said first block, said closure lid being operative, when closed, to cover a top end of said cylindrical bore, contact adhesive applied to a top surface of said first block and a bottom surface of said lip for releasably sealing said lid in a closed position relative to said first block, a closed and sealed hollow plastic container of refreezable liquid located within said bore, a plastic vial located within said bore, said vial being adapted to receive a container of temperature-sensitive pharmaceutical preparation, and said hollow plastic container being generally spherical in shape and slightly smaller in diameter than the diameter of said cylindrical bore.

3. The portable carrier of claim 2 wherein said plastic vial is generally cylindrical in configuration.

* * * * *

UNITED STATES PATENT AND TRADEMARK OFFICE

CERTIFICATE OF CORRECTION

PATENT NO. : 4,955,480

DATED : September 11, 1990

INVENTOR(S) : Wilson C. Sexton

It is certified that error appears in the above-identified patent and that said Letters Patent is hereby corrected as shown below:

Column 4, Line 56, change "lip" to ---lid---.

Signed and Sealed this

Thirtieth Day of June, 1992

*Attest:*

DOUGLAS B. COMER

*Attesting Officer*

*Acting Commissioner of Patents and Trademarks*